US009738963B2

(12) United States Patent
Watanabe et al.

(10) Patent No.: US 9,738,963 B2
(45) Date of Patent: Aug. 22, 2017

(54) METHOD FOR MANUFACTURING FERRITIC STAINLESS STEEL PRODUCT

(71) Applicant: DENSO CORPORATION, Kariya, Aichi-pref. (JP)

(72) Inventors: Teppei Watanabe, Okazaki (JP); Atsushi Iwase, Okazaki (JP)

(73) Assignee: DENSO CORPORATION, Kariya, Aichi-pref. (JP)

( * ) Notice: Subject to any disclaimer, the term of this patent is extended or adjusted under 35 U.S.C. 154(b) by 674 days.

(21) Appl. No.: 14/220,210

(22) Filed: Mar. 20, 2014

(65) Prior Publication Data

US 2014/0283955 A1 Sep. 25, 2014

(30) Foreign Application Priority Data

Mar. 21, 2013 (JP) ..... 2013-058113

(51) Int. Cl.

| | |
|---|---|
| ***C23C 8/26*** | (2006.01) |
| ***C21D 6/00*** | (2006.01) |
| ***C21D 9/00*** | (2006.01) |
| ***C21D 1/06*** | (2006.01) |

(52) U.S. Cl.

CPC ..... *C23C 8/26* (2013.01); *C21D 1/06* (2013.01); *C21D 6/00* (2013.01); *C21D 6/002* (2013.01); *C21D 9/0062* (2013.01); *C21D 2211/005* (2013.01)

(58) Field of Classification Search

CPC ..... C23C 8/26

See application file for complete search history.

(56) References Cited

U.S. PATENT DOCUMENTS

| | | | | |
|---|---|---|---|---|
| 4,047,981 | A * | 9/1977 | Arnold | C22C 38/28 148/207 |
| 2004/0055670 | A1 | 3/2004 | Lippmann et al. | |
| 2006/0037669 | A1 | 2/2006 | Kuroda et al. | |
| 2007/0186999 | A1 | 8/2007 | Kuroda et al. | |
| 2012/0325373 | A1 | 12/2012 | Morizono et al. | |

FOREIGN PATENT DOCUMENTS

| | | |
|---|---|---|
| JP | 05-311336 | 11/1993 |
| JP | H10219418 A | 8/1998 |
| JP | 11-050203 | 2/1999 |

(Continued)

OTHER PUBLICATIONS

Office Action dated Mar. 24, 2015 in corresponding Japanese Application No. 2013-58113.

(Continued)

*Primary Examiner* — Veronica F Faison

(74) *Attorney, Agent, or Firm* — Harness, Dickey & Pierce, P.L.C.

(57) ABSTRACT

In a method for manufacturing a ferritic stainless steel product, a ferritic stainless steel object is heated in an inert gas atmosphere including nitrogen gas in a heating furnace at a nitriding temperature higher than or equal to a transformation temperature so as to form a nitrided layer on a surface of the ferritic stainless steel object. Moreover, the nitriding temperature is set lower than 1100° C. during the heating. The heating of the ferritic stainless steel object is performed in a state where a solid carbon exists inside the heating furnace.

8 Claims, 4 Drawing Sheets

(56) References Cited

FOREIGN PATENT DOCUMENTS

| | | |
|---|---|---|
| JP | 2004-068115 | 3/2004 |
| JP | 2005-503488 | 2/2005 |
| JP | 2006-316338 | 11/2006 |
| JP | 2007-046088 | 2/2007 |
| JP | 2007-126709 | 5/2007 |
| JP | WO 2011/092998 | 8/2011 |

OTHER PUBLICATIONS

Office Action dated Mar. 24, 2005 in corresponding Japanese Application No. 2013-58113.

* cited by examiner

METHOD FOR MANUFACTURING FERRITIC STAINLESS STEEL PRODUCT

CROSS REFERENCE TO RELATED APPLICATION

This application is based on and incorporates herein by reference Japanese Patent Application No. 2013-058113 filed on Mar. 21, 2013.

TECHNICAL FIELD

The present disclosure relates to a method for manufacturing a ferritic stainless steel product via high-temperature nitridation of ferritic stainless steel.

BACKGROUND

Conventionally, as a method for modifying a surface of ferritic stainless steel, a high-temperature nitridation method is known, in which a ferritic stainless steel is heated at a nitriding temperature higher than a transformation temperature in an atmosphere of an inert gas containing nitrogen gas: $N_2$ (e.g., Patent Document 1: JP 2006-316338 A corresponding to US 2007/0186999 A1). According to the high-temperature nitridation method, a nitrided layer can be formed on the surface of the ferritic stainless steel, and hardness and corrosion resistance of the ferritic stainless steel can be improved.

In Patent Document 1, it is described that a preferable range of the nitriding temperature is from 1150 to 1200° C. Moreover, in Patent Document 1, a removing process, in which a passive layer on a surface of a ferritic stainless steel is removed, is performed before the high-temperature nitridation process. The removing process is reduction treatment by using hydrogen gas.

The present inventors perform such high-temperature nitridation of a ferritic stainless steel at various nitriding temperatures. When the nitriding temperature is lower than 1110° C., a nitrided layer is not generated stably. Stable generation of the nitrided layer means that the nitrided layer is formed on all treated objects when the treated objects are nitrided in the same furnace at the same time. Therefore, incapability of the stable generation of the nitrided layer means that the nitrided layer is not formed on all or a part of the treated objects when the treated objects are nitrided in the same furnace at the same time. One reason why may be that removing of a passive layer existing on the surface of the ferritic stainless steel is insufficient, and nitrogen as a solute cannot mix stably with the surface of the ferritic stainless steel as a solvent to form a solid solution, at a nitriding temperature below 1100° C.

When the nitriding temperature is set higher than or equal to 1100° C., the nitrided layer can be formed stably. However, in this case, coarsening of crystal grain in a metallic structure may be occurred, and a lifetime of a furnace or a thermal treatment jig may be shortened.

In Patent Document 1, the removing process, in which the passive layer is removed by reduction treatment with hydrogen gas, is performed before the nitridation process. Thus, a device for introducing or discharging the hydrogen gas to or from the heating furnace may be necessary, and an equipment including the heating furnace may become complicated as a whole.

In Patent Document 1, when the product is produced in a large scale, the nitridation process is performed on each product or each batch. Before each nitridation process, it may be necessary to perform the removing process of the passive layer.

SUMMARY

It is an objective of the present disclosure to enable a nitrided layer to form on a ferritic stainless steel stably even at a nitriding temperature lower than 1100° C.

According to an aspect of the present disclosure, a method for manufacturing a ferritic stainless steel product is disclosed. In the method, a ferritic stainless steel object is heated in an inert gas atmosphere including nitrogen gas in a heating furnace at a nitriding temperature higher than or equal to a transformation temperature so as to form a nitrided layer on a surface of the ferritic stainless steel object. Moreover, the nitriding temperature is set lower than 1100° C. during the heating. The heating of the ferritic stainless steel object is performed in a state where a solid carbon exists inside the heating furnace.

Accordingly, though the nitriding temperature is set lower than 1100° C., a passive layer existing on the ferritic stainless steel object can be removed sufficiently by the action of the solid carbon existing inside the heating furnace and the action of carbon contained in the ferritic stainless steel objects. Therefore, the nitrided layer can be formed on the surface of the ferritic stainless steel object stably.

BRIEF DESCRIPTION OF THE DRAWINGS

The disclosure, together with additional objectives, features and advantages thereof, will be best understood from the following description, the appended claims and the accompanying drawings, in which:

DETAILED DESCRIPTION

An exemplar embodiment of the present disclosure will be described below. In the exemplar embodiment, an object to be treated, which is made of ferritic stainless steel, is heated in an atmosphere of an inert gas containing nitrogen gas ($N_2$) in a heating furnace such that a nitrided layer is formed on the object. Accordingly, a nitridation process is performed, and a ferritic stainless steel product is manufactured.

A product manufactured in the present embodiment may be used for a control part for an engine of a vehicle, a fuel-system part or an exhaust-system part, for example. The present disclosure may be applied to manufacturing of a product required to have high hardness and high corrosion resistance.

A variety of furnace, such as a batch furnace or a continuous furnace, may be used as the heating furnace used in the nitridation process. The heating furnace is a closed furnace provided with a vacuum device.

In the present embodiment, the nitridation process is performed in a state where solid carbon exists inside the heating furnace. Thus, a furnace-wall coating process is performed before the nitridation process. In the furnace-wall coating process, an inner wall of the heating furnace is coated with the solid carbon. Therefore, the heating furnace, in which the inner wall has been coated with the solid carbon in the furnace-wall coating process, is used in the nitridation process.

More specifically, in the furnace-wall coating process, a carbon supply gas is introduced into the heating furnace having the inner wall made of, for example, stainless steel, and then an inside of the heating furnace is heated. The carbon supply gas may be, for example, acetylene: $C_2H_2$, methane: $CH_4$ or carbon monoxide: CO. Accordingly, the inner wall of the heating furnace can be directly coated with solid carbon. An entire inner wall of the heating furnace may be coated with the solid carbon.

Figure 1:
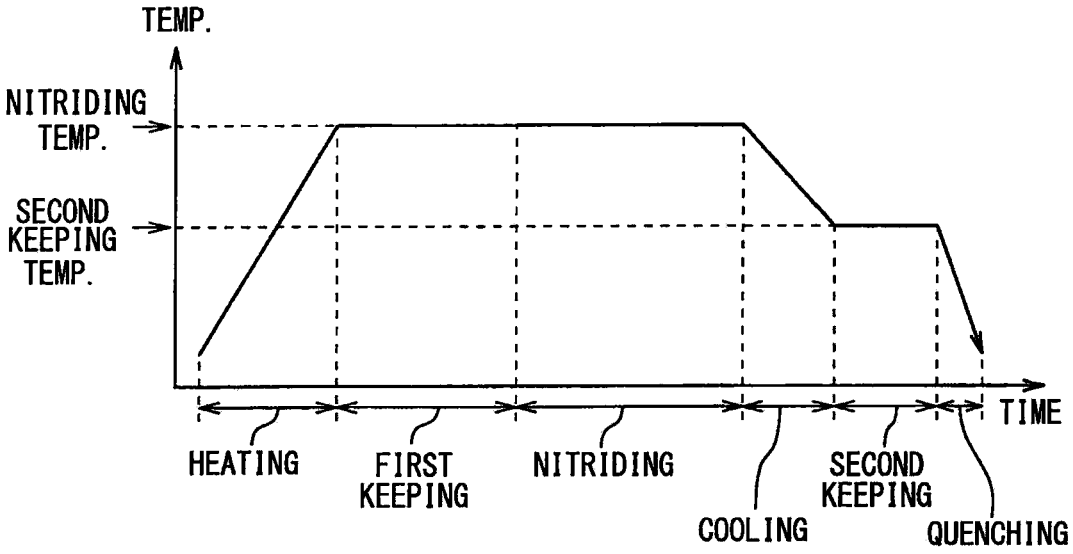
FIG. 1 is a diagram showing a relationship between temperature and time in a nitridation process according to an exemplar embodiment of the present disclosure.

As shown in FIG. 1, the nitridation process includes a heating step, a first temperature keeping step, a nitridation step, a cooling step, a second temperature keeping step and a quenching step.

At the heating step and the first temperature keeping step, the inside of the heating furnace in which the object is located is heated to and kept at a nitriding temperature. At these steps, the inside of the heating furnace may be made to be vacuum lower than 10 Pa or may have a pressure within a range from 10 Pa to 101300 Pa (atmospheric pressure). Additionally, a gas may be introduced into the heating furnace at these steps. For example, the introduced gas may be a pure gas of $N_2$ or Ar, or may be a mixed gas of $N_2$ and Ar.

At the nitridation step, an inert gas containing $N_2$ gas is introduced into the heating furnace while the inside of the heating furnace is heated at a nitriding temperature higher than or equal to a transformation temperature. The transform temperature is a temperature at which a part of a ferritic phase transforms into an austenitic phase. The inert gas introduced into the heating furnace may be pure $N_2$ gas or mixed gas of $N_2$ and Ar, for example. A total pressure in the heating furnace at the nitridation step may be set within a range from 10000 Pa to 101300 Pa (atmospheric pressure). According to Sieverts's law, a concentration of nitrogen in the surface of the object during nitridation is proportional to the square root of a partial pressure of nitrogen gas. Hence, the higher the partial pressure of nitrogen, the shorter time required for the nitridation. When the total pressure during the nitridation is higher than or equal to 30000 Pa, convection of gas is accelerated. Thus, the atmosphere gas can be made to contact the surface of the object more, and gas desorbed from the object can be removed promptly. When the total pressure during the nitridation is lower than or equal to 90000 Pa, oxygen incorporation from an atmosphere into the heating furnace can be prevented effectively.

At the cooling step and the second temperature keeping step, the inside of the heating furnace in which the object is located is cooled from the nitriding temperature to a predetermined temperature and kept at the predetermined temperature. At these steps, the inside of the heating furnace may be made to be vacuum lower than 10 Pa or may have a pressure within a range from 10 Pa to 101300 Pa (atmospheric pressure). Additionally, a gas may be introduced into the heating furnace at these steps. For example, the introduced gas may be a pure gas of $N_2$ or Ar, or may be a mixed gas of $N_2$ and Ar. The cooing step and the second temperature keeping step may be omitted in the nitridation process.

At the quenching step, the object is quenched. After the quenching step, a sub-zero treatment or tempering may be performed additionally as necessary. The nitrided layer after the nitridation process has a martensitic phase or an austenitic phase depending on composition of material of the object.

Next, the nitriding temperature during the nitriding step and the composition of a material of the object to be treated will be described. At the nitridation step, the nitriding temperature is set within a shaded area in FIG. 2 in accordance with a carbon content and a chrome content in the material. When the nitriding temperature is defined as A ° C., and when the carbon content and the chrome content are defined as B wt % and C wt %, respectively, the following conditions are satisfied in the present embodiment: A<1100; 0<B<0.2; and 14≤C≤24. Furthermore, the following formula (1) is satisfied.

$$\log B > \frac{13686}{A+273} + \frac{2}{3} \times \log C - 13.1 \tag{1}$$

The formula (1) is derived, as described below, by the present inventors from conditional formulae which are obtained when removal reaction of a passive layer proceeds in the presence of solid carbon in the heating furnace. When the nitriding temperature satisfies the formula (1), a passive layer existing on the surface of the ferritic stainless steel can be removed at the nitridation step, and a nitrided layer can be formed on the surface of the ferritic stainless layer stably.

The passive layer existing on the surface of the ferritic stainless steel is made of chromium (III) oxide: $Cr_2O_3$, and the removal reaction of the passive layer is expressed in the below-described first reaction formula. A free energy change $\Delta G^0{}_1$ in the removal reaction of the passive layer is expressed in the below-described formula (2) by using standard free energies $\Delta G^0{}_{co}$ and $\Delta G^0{}_{Cr2O3}$ of formation of CO and $Cr_2O_3$ which are expressed in the below-described second and third reaction formulae. <C> and <Cr> in the below-described reaction formula indicate, respectively, C and Cr incorporated as solutes into the stainless steel used as a solvent of solid solution. (s) and (g) in the below-described reaction formulae indicate a solid state and a gas state, respectively.

$$\mathrm{Cr_2O_3}(s) + 3\langle \mathrm{C}\rangle \rightarrow 2\langle \mathrm{Cr}\rangle + 3\mathrm{CO}(g);\ \Delta G_1^0 \tag{2}$$

$$\mathrm{C}(s) + \frac{1}{2}\mathrm{O_2}(g) \rightarrow \mathrm{CO}(g);\ \Delta G_{CO}^0$$

$$2\mathrm{Cr}(s) + \frac{3}{2}\mathrm{O_2}(g) \rightarrow \mathrm{Cr_2O_3}(s);\ \Delta G_{Cr_2O_3}^0$$

$$\Delta G_1^0 = \Delta G_{CO}^0 \times 3 - \Delta G_{Cr_2O_3}^0$$

In order to accelerate the removal reaction of the passive layer expressed in the above-described first reaction formula, the free energy change of the removal reaction of the passive layer is required to be a negative value, according to, for example, "Chemical Thermodynamics" written by Kei Watanabe and published by Saiensu-sha Co., Ltd. Publishers. Therefore, a condition to accelerate the removal reaction of the passive layer is expressed in the following formula (3).

$$\Delta G_1^0 + RTIn\left(\frac{a_{Cr}^2 P_{CO}^3}{a_C^3 a_{Cr_2O_3}}\right) < 0 \tag{3}$$

In the formula (3), R represents a gas constant, T represents an absolute temperature, $a_{cs}$ represents an activity of Cr incorporated as a solute into the stainless steel, $P_{co}$ represents a partial pressure of CO gas, $a_c$ represents an activity of C incorporated as a solute into the stainless steel, and $a_{Cr2O3}$ represents an activity of $Cr_2O_3$.

$Cr_2O_3$ is assumed to be pure (i.e. $a_{Cr2O3}=1$), and activities $a_{Cr}$ of Cr and $a_c$ of C are assumed to be equal to molar fractions $X_{Cr}$ of Cr and $X_C$ of C, respectively (i.e. $a_{Cr}=X_{Cr}$, $a_c=X_C$). Moreover, $\Delta G^0{}_1$ is obtained by substituting general thermodynamic data of $\Delta G^0{}_{Cr2O3}$ and $\Delta G^0{}_{CO}$: $\Delta G^0{}_{Cr2O3}=259.83\times T-1120266$ [J]; and $\Delta G^0{}_{CO}=-87.66\times T-111720$ [J], into the formula (2), and the obtained $\Delta G^0{}_1$ is substituted into the formula (3). Accordingly, the following formula (4) is obtained from the formula (3).

$$\log X_C > \log P_{CO} + \frac{2}{3}\times\log X_{Cr} + \frac{13686}{T} - 9.1 \quad (4)$$

A measurement value of the partial pressure $P_{CO}$ ($P_{CO}=10^{-4}$ [atm]) is substituted into the formula (4). In the formula (4), additionally, unit conversions are performed from the absolute temperature T to the nitriding temperature A ° C., from the molar fraction $X_C$ of carbon to the carbon content B wt % in the material, and from the molar fraction $X_{Cr}$ of chrome to the chrome content C wt % in the material. As a result, the formula (1) is obtained. The measurement value of $P_{CO}$ is a measurement result of a partial pressure of CO inside the heating furnace.

Figure 2:
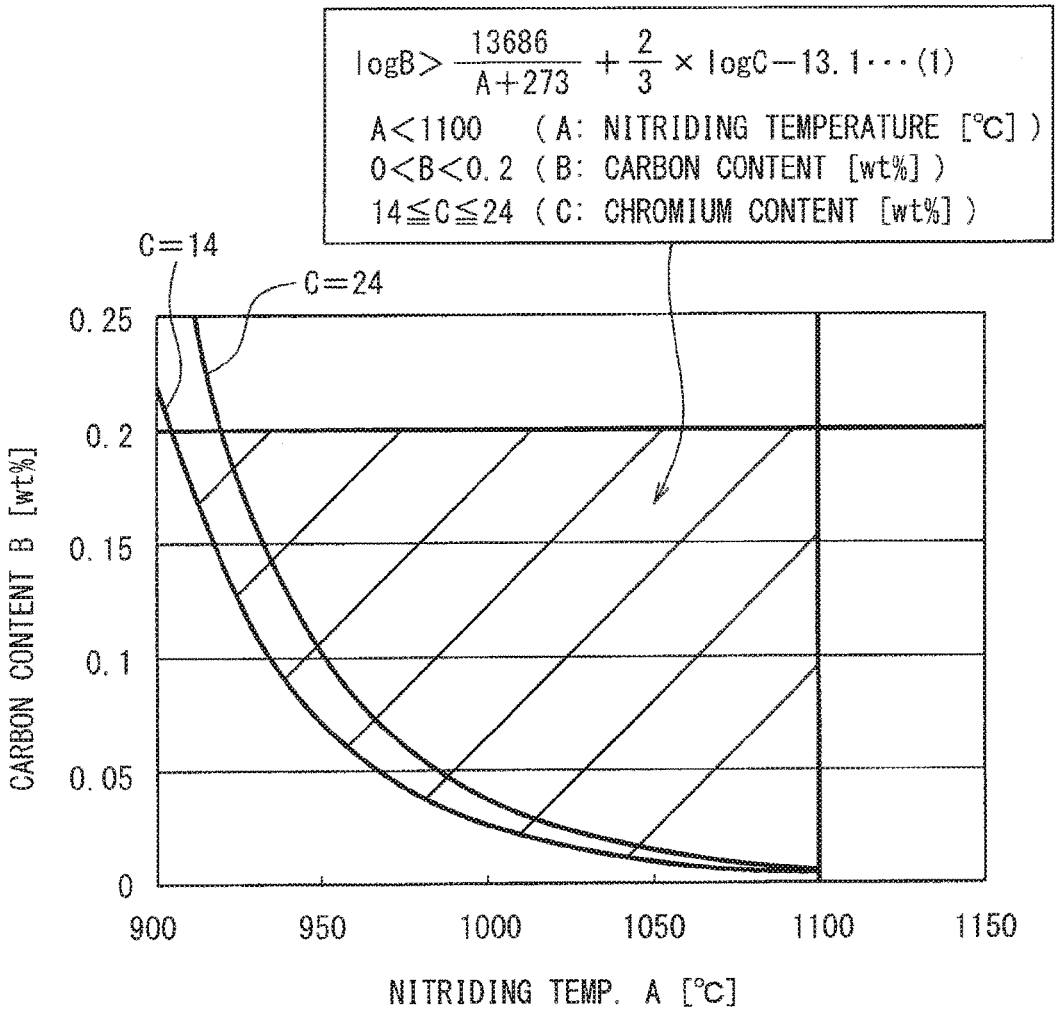
FIG. 2 is a diagram showing a range of a nitriding temperature in the nitridation process according to the exemplar embodiment.

The nitriding temperature is set within the shaded area shown in FIG. 2 in accordance with use application of the treated object. When the nitriding temperature is set low, coarsening of crystal grain in a metallic structure can be restricted effectively and life times of the heating furnace and a thermal treatment jig can be increased. When the nitriding temperature is set high, a diffusion coefficient of nitrogen is enhanced, and thus the nitrided layer can be formed in a shorter time.

The carbon content in the material of the treated object is set lower than 0.2 wt % (i.e. B<0.2) for preventing deterioration in corrosion resistance due to excessively high content of carbon. The chrome content is set higher than or equal to 14 wt % (C≥14). If the chrome content is lower than 14 wt %, the nitrogen may not be incorporated as a solute into the surface of the ferritic stainless steel effectively. Moreover, the chrome content is set lower than or equal to 24 wt %. According to an experimental result of the inventors, when the chrome content exceeds 24 wt %, the passive layer on the surface of the ferritic stainless steel becomes robust and difficult to be removed. According to the experimental result of the inventors, the chrome content may be higher than or equal to 16 wt % and lower than or equal to 18 wt %. The material of the treated object may include other contents other than carbon and chrome.

Next, effects of the present embodiment will be described.

(1) In the present embodiment, the nitriding temperature is set lower than 1100° C., and the nitridation process is performed by using the heating furnace in which the inner wall of the heating furnace is coated with solid carbon.

If a heating furnace in which an inner wall of the heating furnace is not coated with solid carbon is used in the nitridation process at a nitriding temperature lower than 1100° C., a nitrided layer may not formed on the surface of the ferritic stainless steel stably. In this case, the passive layer, which is made of $Cr_2O_3$ and exists on the surface of the ferritic stainless steel, may be removed insufficient at the nitriding temperature lower than 1100° C., and thus the nitrogen may not be incorporated as a solute into the surface of the ferritic stainless steel stably.

On the other hand, in the present embodiment, the nitridation process is performed by using the heating furnace in which the inner wall of the heating furnace is coated with solid carbon. Thus, the passive layer can be removed by the action of solid carbon existing in the inner wall of the heating furnace and the action of carbon contained in the material of the treated object. More specifically, the solid carbon existing in the inner wall of the heating furnace and the carbon contained in the material react with oxygen in the atmosphere inside the heating furnace. Accordingly, a partial pressure of residual oxygen in the atmosphere inside the heating furnace is reduced, and thus reduction reaction of the passive layer occurs easily. As a result, the passive layer can be removed.

Therefore, even when the nitriding temperature is set lower than 1100° C., the nitrogen can be incorporated as a solute into the surface of the ferritic stainless steel stably, and the nitrided layer can be formed stably. Consequently, the coarsening of crystal grain of the ferritic stainless steel can be restricted, and life times of the heating furnace and the thermal treatment jig can be enhanced, as compared with a case where a heating furnace in which an inner wall of the heating furnace is not coated with solid carbon is used in the nitridation process at a temperature higher than or equal to 1100° C.

(2) In the present embodiment, the furnace-wall coating process, in which the inner wall of the heating furnace is coated with solid carbon, is performed before the nitridation process. In the furnace-wall coating process, the carbon supply gas is introduced into the inside of the heating furnace that is to be used in the nitridation process, and the inside of the furnace is heated.

In the present embodiment, the passive layer can be removed during the nitridation process, and there is no need to remove the passive layer before the nitridation process. Therefore, there is no need to introduce hydrogen gas for removal of the passive layer before the nitridation process, and the equipment for the nitridation can be simplified.

In the present embodiment, the heating furnace can be used repeatedly for the nitridation process in large-scale production until the solid carbon in the surface of the heating furnace is exhausted. Thus, in the present embodiment, if the furnace-wall coating process is performed before the nitridation process once, it is unnecessary to perform the furnace-wall coating process before subsequent nitridation processes until the solid carbon in the surface of the heating furnace is exhausted. Therefore, productivity can be increased.

Although the present disclosure has been fully described in connection with the preferred embodiments thereof with reference to the accompanying drawings, the present disclosure is not limited to the above-described embodiment and can be changed or modified arbitrarily within the scope of the present disclosure, as described below.

In the above-described embodiment, the heating furnace having the inner wall that is coated with the solid carbon in the furnace-wall coating process is used in the nitridation process, but another heating furnace in which solid carbon exists may be used alternatively. For example, a heating furnace in which a muffle made of carbon is arranged may be used.

In the above-described embodiment, an element constituting the embodiment is not necessarily required except for a case in which the element is required particularly or a case in which the element is clearly required in principle.

A working example and a reference example of the present disclosure will be described. The furnace-wall coating process is performed with respect to a nitridation chamber 2 of a nitridation furnace 1 shown in FIG. 3, and then the nitridation process is performed with respect to an object 10 having a circular-plate shape by using the nitridation chamber 2.

Figure 3:
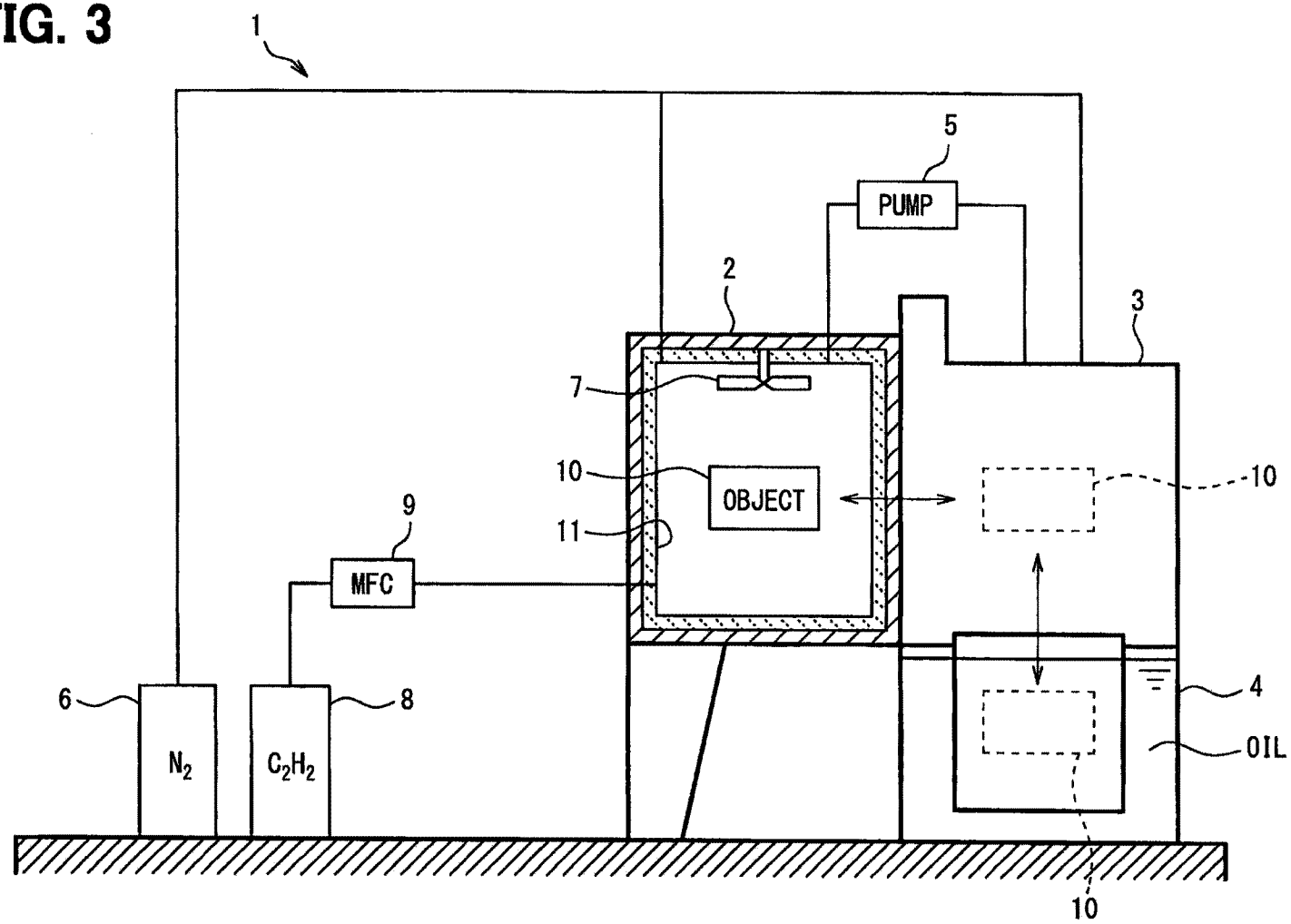
FIG. 3 is a schematic diagram showing a heating furnace used in a working example of the present disclosure.

The nitridation furnace shown in FIG. 3 includes the nitridation chamber 2 as a high temperature portion, and a cooling chamber 3. An inside of the nitridation chamber 2 is heated by a non-shown heater. The nitridation chamber 2 may be used as an example of a heating furnace in which an object made of ferritic stainless steel is arranged and heated. An inner wall of the nitridation chamber 2 is made of heat-resistant stainless steel. The cooling chamber 3 is provided with an oil bath 4 for cooling. Both the nitridation chamber 2 and the cooling chamber 3 are connected to a vacuum pump 5 and a $N_2$ gas canister 6 capable of pressurizing more than atmospheric pressure. A convection fan 7 is disposed in the nitridation chamber 2. The nitridation chamber 2 is connected to a $C_2H_2$ gas canister 8 through a mass flow controller 9 (MFC). A non-shown carrier device is attached between the nitridation chamber 2 and the cooling chamber 3 and is capable of conveying the object 10 between the nitridation chamber 2 and the cooling chamber 3. A non-shown elevator is provided in the cooling chamber 3 to transfer the object 10 into and from the oil bath 4.

In the furnace-wall coating process, the nitridation chamber 2 is heated to 900° C. in furnace temperature at a heating rate 1000° C./hr, while the nitridation chamber 2 is vacuumed, without the object 10 being located inside the nitridation chamber 2. Next, in order to keep the temperature of the nitridation chamber 2 as a whole, the furnace temperature is kept at 900° C. for 30 minutes with vacuuming the nitridation chamber 2. Then, $C_2H_2$ gas is introduced into the nitridation chamber 2 through the mas flow controller 9 at 30 slm (standard liters per minute) for one hour while the nitridation chamber 2 is connected to the vacuum pump 5. Subsequently, the $C_2H_2$ gas introduction is terminated, and $N_2$ gas is injected into nitridation chamber 2 to 50000 Pa. The nitridation chamber 2 is cooled to 700° C. Accordingly, $C_2H_2$ gas is decomposed, and solid carbon 11 adheres to the inner wall of the nitridation chamber 2. The inner wall of the nitridation chamber 2 is coated with the solid carbon 11.

In the nitridation process, three kinds of the object 10 are prepared as shown in Table 1. The three kinds of the object 10 are made of JIS SUS430 stainless steel and have compositions 1 to 3, respectively. Residual contents other than contents of each composition 1 to 3 shown in Table 1 are Fe and other inevitable impurities.

TABLE 1

| | Contents (wt %) | | | | | | |
|---|---|---|---|---|---|---|---|
| Composition | C | Si | Mn | P | S | Ni | Cr |
| 1 | 0.10 | 0.3 | 0.85 | 0.028 | 0.002 | 0.23 | 16.25 |
| 2 | 0.04 | 0.34 | 0.29 | 0.021 | 0.02 | 0.23 | 16.48 |
| 3 | 0.01 | 0.27 | 0.34 | 0.024 | 0.004 | 0.15 | 16.57 |

The object 10 which has been degreased sufficiently is arranged in a basket made of JIS SUS304 stainless steel and inserted into the nitridation chamber 2. The nitridation chamber 2 is heated to a predetermined nitriding temperature at a heating rate 1000° C./hr with vacuuming the nitridation chamber 2 (heating step). In order to keep the temperature of the object 10 as a whole, the predetermined nitriding temperature is kept for 30 minutes with vacuuming the nitridation chamber 2 (first temperature keeping step). Subsequently, the vacuum pump 5 is stopped, and $N_2$ gas is introduced into the nitridation chamber 2 to 50000 Pa with operating the convection fan 7 (nitridation step).

Next, the heater of the nitridation chamber 2 is turned off, and the nitridation chamber 2 is cooled to 950° C. (cooling step). Then, the nitridation chamber 2 is kept at 950° C. for 30 minutes in order to keep the temperature of the object 10 as a whole (second temperature keeping step). When the nitriding temperature is set lower than or equal to 950° C., the cooling step and the second temperature keeping step may be omitted.

Next, the object 10 is carried from the nitridation chamber 2 to the cooling chamber 3 and inserted into the oil bath 4. After oil cooling of the object 10 for 10 minutes, the elevator is lifted up, and oil of the object 10 is drained (quenching step). Subsequently, a pressure in the cooling chamber 3 is increased to the atmosphere pressure in a nitrogen atmosphere, and then the object 10 is ejected from the cooling chamber 3 to an exterior of the furnace.

Texture observation by using a metallurgical microscope is performed with respect to the objects 10 nitrided at respective temperatures, and it is confirmed whether the nitrided layer (hardened layer) is formed stably.

In a comparative example, a nitridation process is performed similar to the working example without performing the furnace-wall coating process by using the nitridation furnace 1 shown in FIG. 1. Thus, the inner wall of the nitridation chamber 2 is not coated with the solid carbon. In this case, the nitriding temperature is set at 1050° C. Also in the comparative example, texture observation by using the metallurgical microscope is performed with respect to the object 10 nitrided, and it is confirmed whether the nitrided layer is formed stably. As a result of the comparative example, the nitrided layer is not formed stably in any one of the three kinds of the object 10 shown in Table 1.

Figure 4:
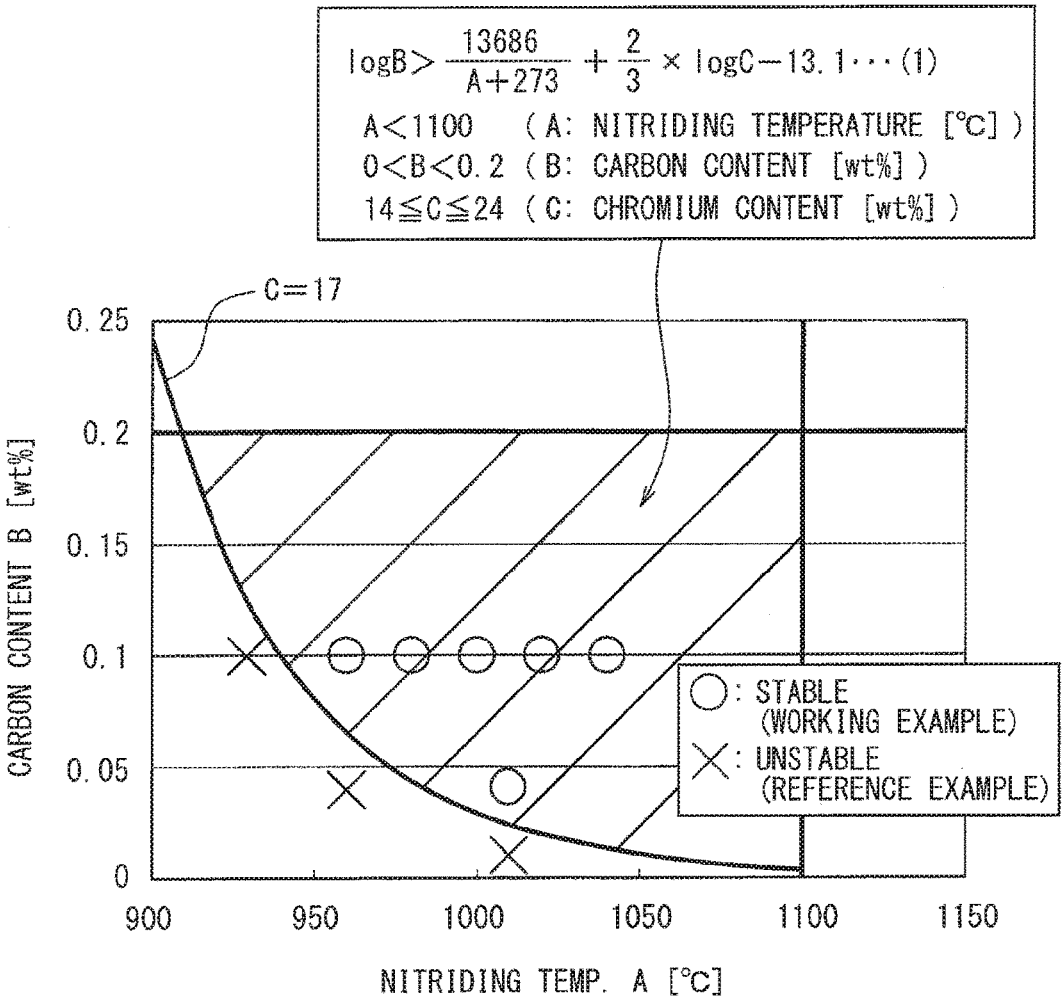
FIG. 4 is a diagram showing results of the working example and a reference example of the present disclosure.

In FIG. 4, a range of the nitriding temperature, derived from the formula (1) is shown. Additionally, in FIG. 4, evaluation results of stable formation of the nitrided layer after the furnace-wall coating process and the nitridation process are shown with overlapping with the range of the nitriding temperature.

The shaded area in FIG. 4 is the range of the nitriding temperature, which is derived from the formula (1) when the chrome content is 17 wt %. The shaded area in FIG. 4 shows that the nitriding temperature should be set higher than 940° C. when the carbon content is 0.10 wt %, higher than 980° C. when the carbon content is 0.04 wt %, and higher than 1070° C. when the carbon content is 0.01 wt %.

The symbols O and x in FIG. 4 are results of evaluation of stable formation of the nitrided layer with respect to five objects under each condition. A condition where the nitrided layer is formed stably in all of the five objects is indicated by O (stable), and a condition where the nitrided layer is not formed stably in at least one of the five objects is indicated by x (unstable). O represents the working example of the present disclosure, and x represents the reference example of the present disclosure.

According to FIG. 4, it is found that the nitrided layer is formed stably under a temperature condition within the shaded area, and the nitrided layer is not formed stably under a temperature condition outside the shaded area. The nitrided layer formed in the working example is made of martensitic stainless steel. When the nitriding temperature is lower than or equal to 1040° C. in the working example, it is found that the coarsening of crystal grain can be limited.

Additional advantages and modifications will readily occur to those skilled in the art. The disclosure in its broader terms is therefore not limited to the specific details, representative apparatus, and illustrative examples shown and described.

What is claimed is:

1. A method for manufacturing a ferritic stainless steel product, the method comprising:

heating a ferritic stainless steel object in an inert gas atmosphere including nitrogen gas in a heating furnace at a nitriding temperature higher than or equal to a transformation temperature so as to form a nitrided layer on a surface of the ferritic stainless steel object; and setting the nitriding temperature lower than 1100° C. during the heating, wherein the heating of the ferritic stainless steel object is performed in a state where a solid carbon exists inside the heating furnace, the state being provided by using the heating furnace in which an inner wall of the heating furnace is covered with solid carbon or a muffle made of carbon is placed inside the heating furnace.

2. The method according to claim 1, wherein when the nitriding temperature is defined as A ° C., and a carbon content and a chrome content in the ferritic stainless steel object are defined, respectively, as B wt % and C wt %, the ferritic stainless steel object satisfies $0<B<0.2$, $14\leq C\leq 24$, and the nitriding temperature satisfies $A<1100$ and the following formula.

$$\log B > \frac{13686}{A+273} + \frac{2}{3} \times \log C - 13.1. \quad (1)$$

3. The method according to claim 1, further comprising providing the solid carbon inside the heating furnace by coating the inner wall of the heating furnace with solid carbon or by placing the muffle in the heating furnace, before the forming of the nitrided layer.

4. The method according to claim 1, wherein the solid carbon is spaced from the ferritic stainless steel object.

5. A method for manufacturing a ferritic stainless steel product, the method comprising:

introducing carbon supply gas into a heating furnace and heating an inside of the heating furnace so as to coat an inner wall of the heating furnace with solid carbon, heating a ferritic stainless steel object in an inert gas atmosphere including nitrogen gas in the heating furnace at a nitriding temperature higher than or equal to a transformation temperature so as to form a nitrided layer on a surface of the ferritic stainless steel object, after the coating of the inner wall of the heating furnace with the solid carbon; and setting the nitriding temperature lower than 1100° C. during the heating.

6. The method according to claim 5, wherein the solid carbon is spaced from the ferritic stainless steel object.

7. A method for manufacturing a ferritic stainless steel product, the method comprising:

placing a muffle made of carbon in a heating furnace, heating a ferritic stainless steel object in an inert gas atmosphere including nitrogen gas in the heating furnace at a nitriding temperature higher than or equal to a transformation temperature so as to form a nitrided layer on a surface of the ferritic stainless steel object, after the placing of the muffle in the heating furnace; and setting the nitriding temperature lower than 1100° C. during the heating.

8. The method according to claim 5, wherein the muffle made of carbon is spaced from the ferritic stainless steel object.

* * * * *